US006135824A

United States Patent [19]

Okabe et al.

[11] Patent Number: 6,135,824

[45] **Date of Patent: *Oct. 24, 2000**

[54] COMBINED CONNECTOR

[75] Inventors: Toshiaki Okabe, Shizuoka; Kouichi Shirouzu, Aichi, both of Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/145,305

[22] Filed: Sep. 2, 1998

[30] Foreign Application Priority Data

Sep. 3, 1997 [JP] Japan ..... 9-238606

[51] Int. Cl.[7] ..... H01R 13/502

[52] U.S. Cl. ..... 439/701; 439/595

[58] Field of Search ..... 439/701, 595, 439/596, 695, 696, 686, 689, 752, 598, 599, 491

[56] References Cited

U.S. PATENT DOCUMENTS 5,211,583 5/1993 Endo et al. ..... 439/595

5,224,876 7/1993 Ito et al. ..... 439/595

FOREIGN PATENT DOCUMENTS 48-578 1/1973 Japan .

2-148583 6/1990 Japan ..... H01R 13/514

2-223171 9/1990 Japan .

*Primary Examiner*—Paula Bradley

*Assistant Examiner*—Ross Gushi

*Attorney, Agent, or Firm*—Sughrue, Mion, Zinn, Macpeak & Seas, PLLC

[57] ABSTRACT

A combined connector including a base housing for receiving metal terminals, and a sub-housing which is inserted in the base housing to be combined therewith, the sub-housing including a cover for closing an open portion of terminal receiving grooves for receiving metal terminals. There is provided a combination-confirming mechanism by which it can be confirmed by the closing of the terminal receiving grooves by the cover of the sub-housing, combined with the base housing, that the sub-housing is properly inserted in and combined with the base housing. Therefore, an incompletely-combined condition can be positively prevented.

6 Claims, 5 Drawing Sheets

COMBINED CONNECTOR

BACKGROUND OF THE INVENTION

1. Field of the Invention

This invention relates to a combined connector which is formed by combining a base housing and a sub-housing together.

2. Description of the Related Art

FIG. 7 shows a combined connector 1 disclosed in Japanese Utility Model Unexamined Publication No. Sho. 48-578. In this Figure, this combined connector 1 comprises two (upper and lower) connector blocks 2 and 3 stacked together in a two-stage manner. A plurality of terminal receiving chambers are formed in rows in each of these connector blocks 2 and 3. Metal terminals 5, each connected to an end of a wire 4, are received respectively in these terminal receiving chambers. Engagement recesses 6 and 6 are formed respectively in opposite side portions of an upper surface of each of the connector blocks 2 and 3, and engagement projections 7 and 7 are formed respectively on opposite side portions of a lower surface thereof.

The two connector blocks 2 and 3 are stacked together, and the engagement projections 7 and 7 of the connector block 2 are engaged respectively in the engagement recesses 6 and 6 of the connector block 3, so that the upper and lower connector blocks 2 and 3 are held in a stacked, combined condition. Another connector block, identical in configuration to the connector blocks 2 and 3, can be stacked on the upper surface of the upper connector block 2, or on the lower surface of the lower connector block 3, and in this manner the connector blocks can be stacked together in a multi-stage manner.

FIG. 8 shows a combined connector 8 disclosed in Japanese Patent Unexamined Publication No. Hei. 2-148583. In this Figure, this combined connector 8 comprises a connector housing body 9, and two slide housings 10 and 11 inserted into the connector housing body 9 in a stacked manner. A plurality of juxtaposed terminal receiving grooves 12 are formed in each of the connector housing body 9 and the slide housings 10 and 11.

Fixing projections 13 are formed respectively on opposite sides of each of the connector housing body 9 and the slide housings 10 and 11. These fixing projections 13 are engageable respectively in fixing windows 15 formed in a U-shaped cover 14. The two slide housings 10 and 11 are inserted into the connector housing body 9, and in this condition the U-shaped cover 14 is attached to the connector housing body 9. In this condition, the fixing projections 13 of the slide housings 10 and 11 and the connector housing body 9 are engaged respectively in the fixing windows 15, so that the slide housings 10 and 11 are held in inserted and combined relation to the connector housing body 9.

However, in the above combined connector 1, when the connector blocks 2 and 3 are stacked together, the engagement projections 7 sometimes fail to be accurately engaged in the associated engagement recesses 6, respectively, so that the two connector blocks are incompletely combined together. If the connector blocks 2 and 3 thus incompletely combined together are connected to an end of a wire harness, and the wire harness is installed, there is a possibility that the connector blocks 2 and 3 are disconnected from each other.

In the above combined connector 8, if the fixing projections 13 are not accurately engaged in the respective fixing windows 15 when the cover 14 is attached to the connector housing body 9 having the slide housings 10 and 11 inserted therein, the connector housing body 9 and the slide housings 10 and 11 are incompletely combined together. In this case, as in the above case, there is a possibility that the slide housings 10 and 11 are disconnected from the connector housing body 9 during the installation of the wire harness.

Besides, if the engagement projections 7 are not sufficiently firmly engaged in the engagement recesses 6, respectively, or if the fixing projections 13 are not sufficiently firmly engaged in the fixing windows 15, respectively, there is a possibility that the engaged condition is accidentally broken during the installation of the wire harness, so that the connector blocks 2 and 3 are disconnected from each other, or the slide housings 10 and 11 are disconnected form the connector housing body 9.

SUMMARY OF THE INVENTION

It is therefore an object of this invention to provide a combined connector in which an incompletely-combined condition is positively prevented, and the strength of holding of the combined condition is enhanced.

In order to achieve the above object, the invention provides a combined connector comprising: a base housing for receiving metal terminals; a sub-housing which is inserted in the base housing to be combined therewith, the sub-housing including a cover for closing an open portion of terminal receiving grooves for receiving metal terminals; and combination-confirming means by which it can be confirmed by the closing of the terminal receiving grooves by the cover of the sub-housing, combined with the base housing, that the sub-housing is properly inserted in and combined with the base housing.

In this combined connector, the sub-housing is inserted into the base housing, and then if the open portion of the terminal receiving grooves in the sub-housing can be closed by the cover, it can be easily confirmed by the combination-confirming means that the sub-housing is properly inserted in and combined with the base housing. If the terminal receiving grooves in the sub-housing can not be closed by the cover, it can be easily confirmed by the combination-confirming means that the sub-housing is not properly inserted in and combined with the base housing.

BRIEF DESCRIPTION OF THE DRAWINGS

FIG. 6(*b*) is a perspective view of the combination-confirming mechanism, showing a condition in which the base housing-side positioning groove is out of alignment with the sub-housing-side positioning groove when the sub-housing is incompletely inserted in and combined with the base housing;

DETAILED DESCRIPTION OF THE PREFERRED EMBODIMENT

Figure 1:
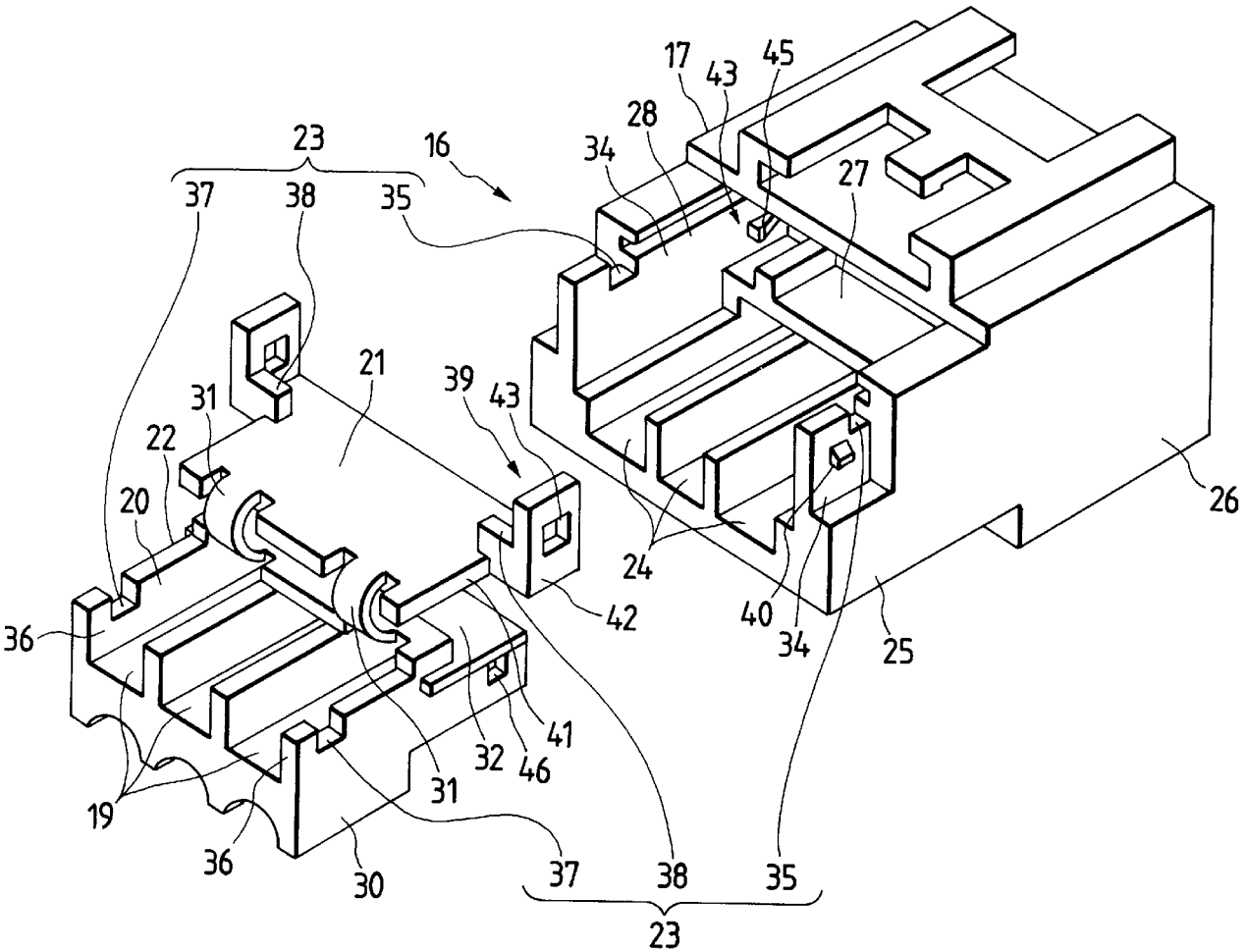
FIG. 1 is an exploded, perspective view of a combined connector of the present invention.
Figure 2:
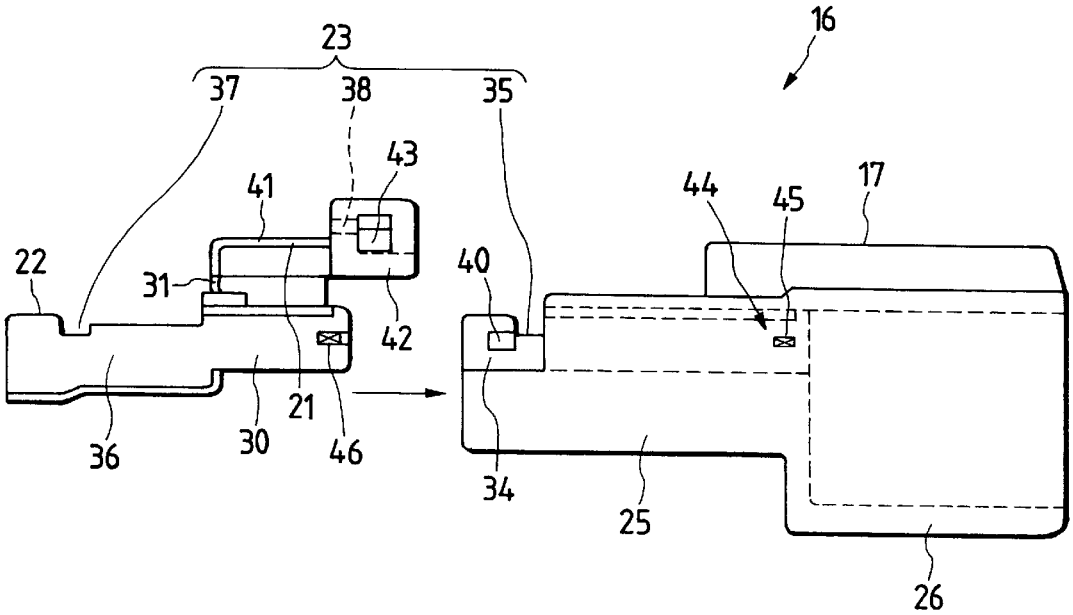
FIG. 2 is a side-elevational view of the combined connector, showing a condition in which a sub-housing and a base housing are disconnected from each other.
Figure 3:
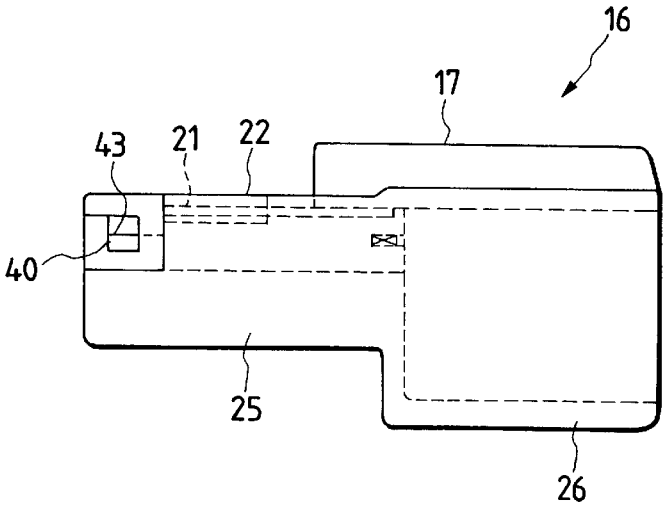
FIG. 3 is a side-elevational view of the combined connector, showing a condition in which the sub-housing is inserted in the base housing to be combined therewith.
Figure 4:
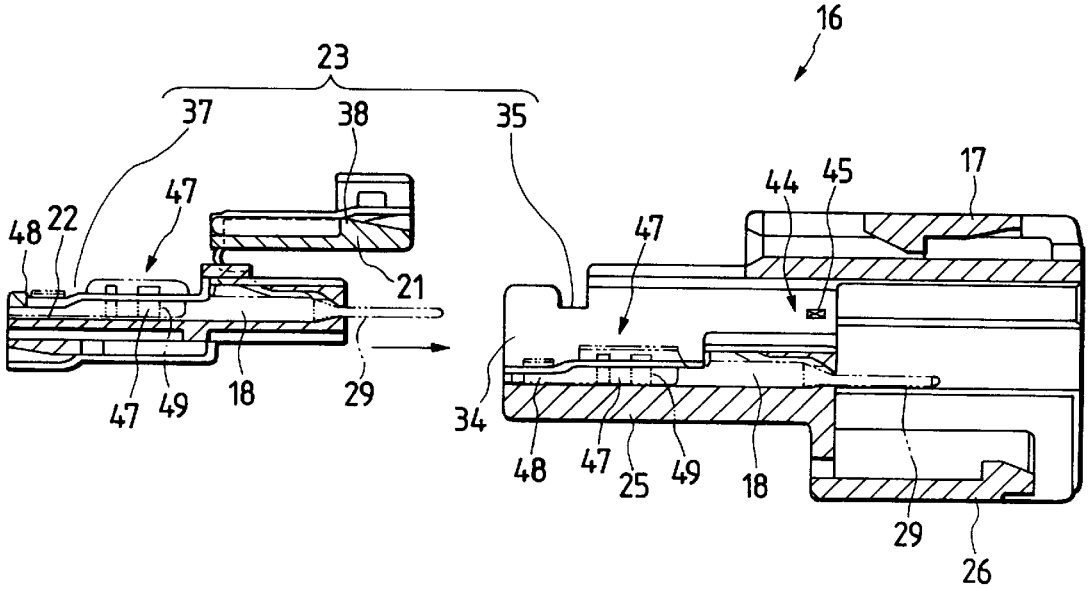
FIG. 4 is a cross-sectional view of the combined connector, showing a condition in which the sub-housing and the base housing are disconnected from each other.
Figure 5:
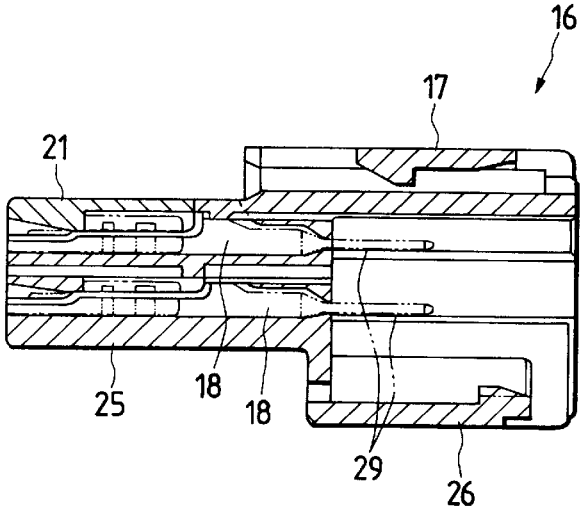
FIG. 5 is a cross-sectional view of the combined connector, showing a condition in which the sub-housing is inserted in the base housing to be combined therewith.

A preferred embodiment of a combined connector of the present invention will now be described. FIG. 1 is an exploded, perspective view of a combined connector 16, FIG. 2 is a side-elevational view showing a condition before a sub-housing 22 is inserted in and combined with a base housing 17, and FIG. 3 is a side-elevational view showing a condition in which the two housings are combined together. FIG. 4 is a cross-sectional view showing the condition of FIG. 2, and FIG. 5 is a cross-sectional view showing the condition of FIG. 3.

As shown in FIG. 1, the combined connector 16 of this embodiment comprises the base housing 17, and the sub-housing 22 which is inserted in and combined with the base housing 17. The sub-housing 22 includes a cover 21 for closing an open portion 20 of terminal receiving grooves 19 which receive male metal terminals 18 (see FIGS. 4 and 5). This combined connector 16 has a combination-confirming mechanism 23 by which it can be confirmed by the closing of the terminal receiving grooves 19 by the cover 21 of the sub-housing 22, combined with the base housing 17, that the sub-housing 22 is properly inserted in and combined with the base housing 17.

The base housing 17 includes a base housing body 25 having a plurality of juxtaposed terminal receiving grooves 24, and a hood portion 26 formed integrally with the base housing body 25. Those portions of the terminal receiving grooves 24, disposed in the hood portion 26, are covered at their upper side with an upper wall 27, and the upper side of those portions of these grooves 24, disposed outwardly of the hood portion 26, is open to provide an open portion 28. Male metal terminals 18 are inserted respectively into the terminal receiving grooves 24 through the open portion 28, and contact portions 29 of these male metal terminals 18 for connection to respective mating terminals project into the interior of the hood portion 26. The open portion 28 of the terminal receiving grooves 24 is closed by the sub-housing 22 inserted in and combined with the base housing 17.

The sub-housing 22 includes a sub-housing body 30 having the plurality of juxtaposed terminal receiving grooves 19, and the cover 21 pivotally connected to the sub-housing body 30 through hinges 31. About a half of each terminal receiving groove 19 is covered with an upper wall 32. The cover 21 is integrally connected to this upper wall 32 through the hinges 31. The other half portions of the terminal receiving grooves 19 are open at their upper side to provide the open portion 20, and this open portion 20 can be opened and closed by the cover 21.

Next, description will be made of the combination-confirming mechanism 23 for enabling the confirmation that the sub-housing 22 is properly inserted in and combined with the base housing 17. The combination-confirming mechanism 23 includes base housing-side positioning grooves 35 formed respectively in those portions of opposite side walls 34 and 34 of the base housing body 25 forming the open portion 28, sub-housing-side positioning grooves 37 formed respectively in those portions of opposite side walls 36 and 36 of the sub-housing body 30 forming the open portion 20, and positioning projections 38 and 38 which are formed respectively on the widthwise opposite sides of the cover 21, and are engageable respectively in the base housing-side positioning grooves 35 and also in the sub-housing-side positioning grooves 37.

Figure 6A:
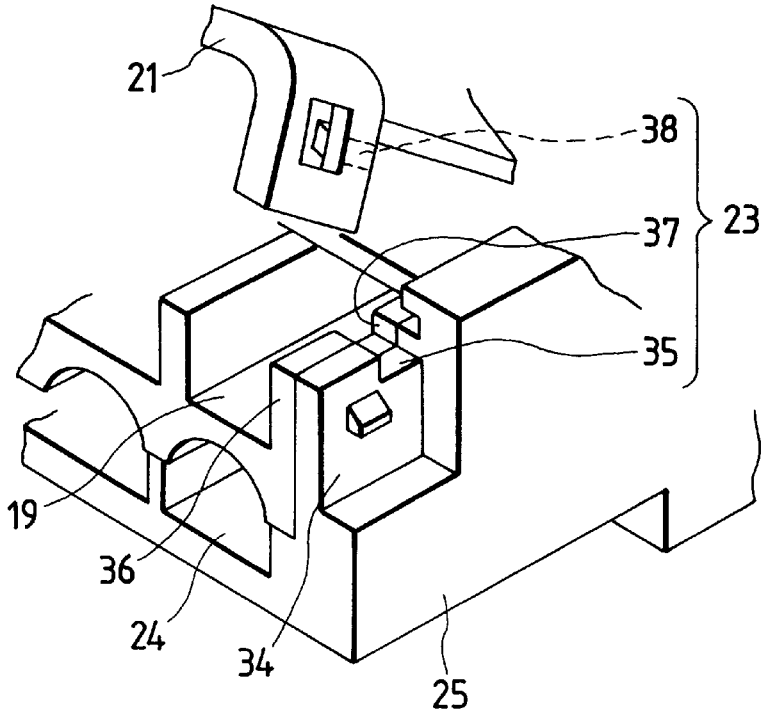
FIG. 6(*a*) is a perspective view of a combination-confirming mechanism, showing a condition in which a base housing-side positioning groove is completely aligned with a sub-housing-side positioning groove when the sub-housing is properly inserted in and combined with the base housing.
Figure 6B:
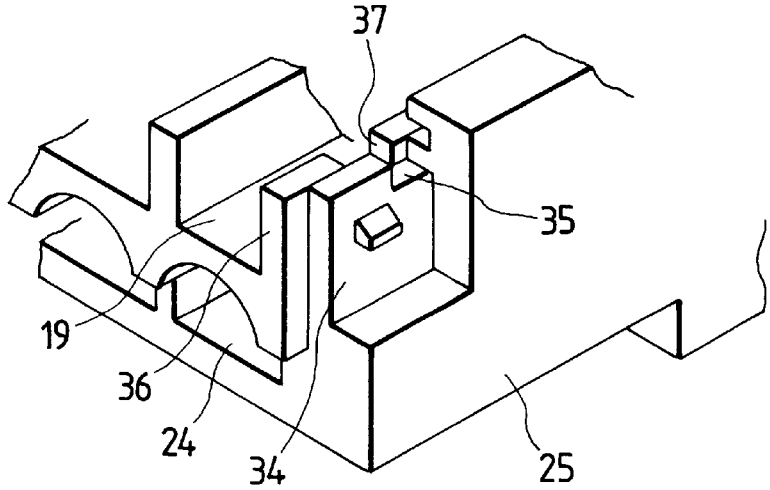
Figure 7:
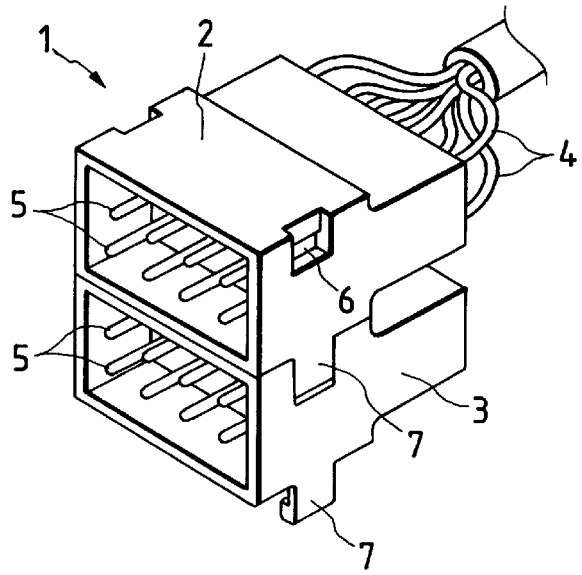
FIG. 7 PRIOR ART
FIG. 7 is a perspective view of a conventional combined connector.
Figure 8:
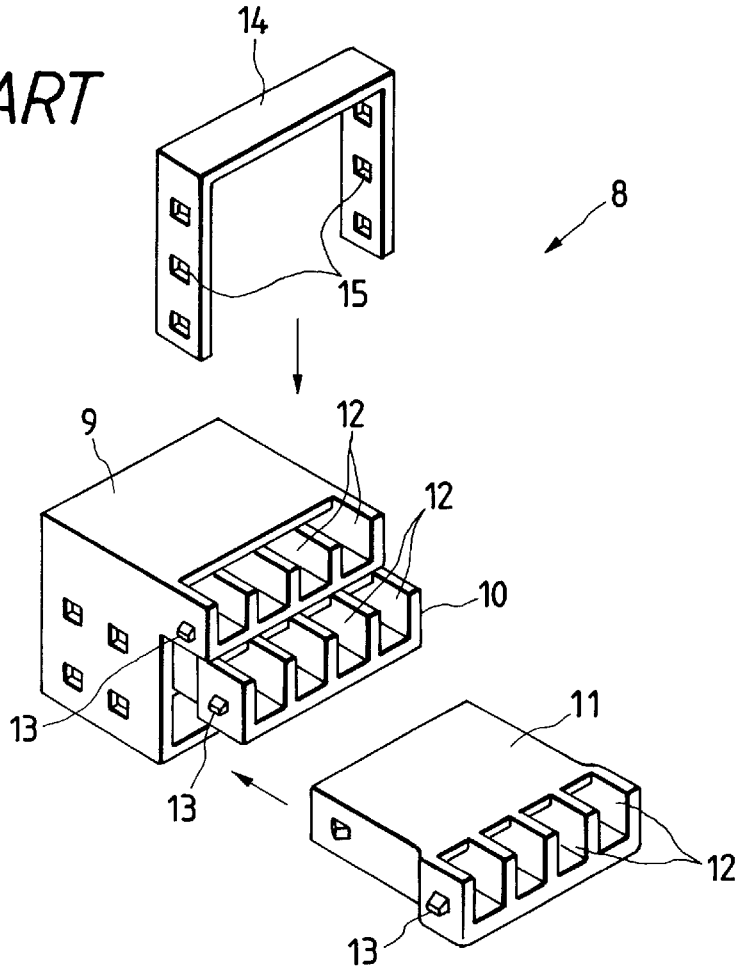
FIG. 8 PRIOR ART
FIG. 8 is an exploded, perspective view of another combined connector.

When the sub-housing 22 is properly inserted in and combined with the base housing 17 as shown in FIGS. 3 and 5, the base housing-side positioning grooves 35 are completely aligned respectively with the sub-housing-side positioning grooves 37 in a contiguous manner, so that each groove 35 cooperates with the associated groove 37 to form a single groove, as shown in FIG. 6(*a*). In this condition, the positioning projections 38, formed on the cover 21, can be fitted in the sub-housing-side positioning grooves 37 and the base housing-side positioning grooves 35.

Therefore, the cover 21 can close the open portion 20 of the terminal receiving grooves 19 in the sub-housing 22, and therefore it can be confirmed from this that the sub-housing 22 is properly inserted in and combined with the base housing 17.

If the sub-housing 22 is not properly inserted in and combined with the base housing 17, each sub-housing-side positioning groove 37 is out of alignment with the associated base housing-side positioning groove 35, as shown in FIG. 6(*b*) , and therefore they can not jointly form one groove. In this condition, each of the positioning projections 38, formed on the cover 21, can not be fitted into the associated base housing-side positioning groove 35 and sub-housing-side positioning groove 37.

Therefore, the open portion 20 of the terminal receiving grooves 19 in the sub-housing 22 can not be closed by the cover 21, and therefore it can be confirmed from this that the sub-housing 22 has not been properly inserted in and combined with the base housing 17. As a result, a condition, in which the terminal receiving grooves 19 in the sub-housing 22 is closed by the cover 21, can not be held by a cover engagement mechanism 39.

The cover engagement mechanism 39 includes engagement projections 40 and 40, formed respectively on the outer surfaces of those portions of the opposite side walls 34 and 34 of the base housing body 25, forming the open portion 28, and engagement recesses 43 and 43 formed respectively in retaining plate portions 42 and 42 formed on and extending substantially perpendicularly from the widthwise opposite sides of the cover 21, respectively. The sub-housing 22 is properly inserted in and combined with the base housing 17, and in this condition, when the open portion 20 of the terminal receiving grooves 19 in the sub-housing 22 is closed by the cover 21, the engagement projections 40 and 40 are retainingly engaged in the engagement recesses 43 and 43, respectively. Namely, when the cover 21 is fixed to the base housing 17, the open portion 20 of the sub-housing 22 is kept closed by the cover 21.

When the sub-housing 22 is properly inserted in and combined with the base housing 17, this combined condition can be held by a combination-holding mechanism 44.

The combination-holding mechanism 44 includes engagement-holding projections 45 and 45, formed respectively on the inner surfaces of the opposite side walls 34 and 34 of the base housing body 25 of the base housing 17, and engagement-holding recesses 46 and 46 formed respectively in the opposite side walls 36 and 36 of the sub-housing body 30 of the sub-housing 22. When the sub-housing 22 is properly inserted in and combined with the base housing 17, this combined condition can be held by retainingly engaging the engagement-holding projections 45 and 45 respectively in the engagement-holding recesses 46 and 46.

Each of the male metal terminals 18, used in this embodiment, is a so-called press-connecting terminal, and has the contact portion 29 at one end portion thereof, and a wire connection portion 47 at the other end portion. The wire connection portion 47 includes a wire holding portion 48, and a press-connecting portion 49, and the press-connecting portion 49 has a pair of opposed press-connecting blades. In this embodiment, the male metal terminals 18 are received respectively in the terminal receiving grooves 19 and 24 of the sub-housing body 30 and the base housing body 25, and in this condition, an end portion of a wire is press-fitted in between the opposed press-connecting blades of the terminal 18, using a press-connecting jig, thereby electrically connecting the wire end to the terminal 18.

Next, the procedure of assembling this combined connector 16 will be described.

First, the male metal terminals 18 are inserted respectively into the terminal receiving grooves 24 in the base housing body 25, and the contact portions 29 thereof are projected into the interior of the hood portion 26. In this condition, the end portions of the wires are press-connected respectively to the press-connecting portions 49, thereby connecting the wires to the terminals 18, respectively, as shown in FIG. 4.

On the other hand, the male metal terminals 18 are inserted respectively into the terminal receiving grooves 19 in the sub-housing body 30, and the contact portions 29 thereof are projected outwardly from the sub-housing body 30. In this condition, the end portions of the wires are press-connected respectively to the press-connecting portions 49, thereby connecting the wires to the terminals 18, respectively, as shown in FIG. 4. At this time, the open portion 20 of the sub-housing 22 is not yet closed by the cover 21.

Then, the sub-housing 22 is inserted into the base housing 17, and the open portion 28 of the base housing body 25 is closed by the sub-housing body 30 of the sub-housing 22. After the sub-housing 22 is thus inserted into the base housing 17, the open portion 20 of the sub-housing 22 is closed by the cover 21.

At this time, if the sub-housing 22 is properly (completely) inserted in and combined with the base housing 17, each of the base housing-side positioning grooves 35 is completely aligned with the associated sub-housing-side positioning groove 37 to form one groove, and therefore when the cover 21 is moved to close the open portion 20 of the sub-housing 22, each of the positioning projections 38 is fitted into the associated one groove. When each positioning projection 38 is fitted into the associated base housing-side positioning groove 35 and sub-housing-side positioning groove 37, the engagement projections 40 are retainingly engaged respectively in the engagement recesses 43, thereby holding the cover 21 in its closed condition in which the open portion 20 of the terminal receiving grooves 19 in the sub-housing 22 is closed by the cover 21. As a result, it can be easily confirmed that the sub-housing 22 is properly inserted in and combined with the base housing 17.

In this condition in which the sub-housing 22 is properly inserted in and combined with the base housing 17, the engagement-holding projections 45 are engaged respectively in the engagement-holding recesses 46, thereby maintaining the condition of combination of the sub-housing 22 with the base housing 17.

In this case, the condition of combination of the sub-housing 22 with the base housing 17 is maintained also by the engagement of the engagement projections 40 (formed on the base housing 17) in the engagement recesses 43 formed in the cover 21 of the sub-housing 22.

If the sub-housing 22 is not properly inserted in and combined with the base housing 17, each base housing-side positioning groove 35 is out of alignment with the associated sub-housing-side positioning groove 37, so that they do not jointly form one groove. Therefore, even if trying to close the open portion 20 of the sub-housing 22 by the cover 21, each positioning projection 38 can not be fitted into the associated sub-housing-side positioning groove 37 and base housing-side positioning groove 35, and therefore the open portion 20 of the sub-housing 22 can not be closed by the cover 21. As a result, it can be easily confirmed that the sub-housing 22 is not properly inserted in and combined with the base housing 17.

Thus, in the combined connector 16 of this embodiment, the condition of combination of the sub-housing 22 with the base housing 17 can be easily confirmed by the combination-confirming mechanism 23, and therefore the sub-housing 22 is positively prevented from being held in incompletely-inserted and combined relation to the base housing 17.

In this embodiment, the sub-housing 22 is held in combined relation to the base housing 17 by the combination-holding mechanism 44, and in addition the sub-housing 22 is held in combined relation to the base housing 17 by engagement of the engagement projections 40 (formed on the base housing body 25) in the engagement recesses 43 in the cover 21. Therefore, the strength of holding of the combined condition is enhanced. With respect to the combination-holding mechanism 44, the projections are engaged respectively in the recesses within the base housing 17, and therefore an external force will not be accidentally applied to the combination-holding mechanism 44 during the installation of a wire harness.

In this embodiment, since the sub-housing 22 can be properly inserted in and combined with the base housing 17, the base housing 17 and the sub-housing 22 will not be disconnected from each other during the installation of the wire harness.

Even if the engagement projections 40 are disengaged respectively from the engagement recesses 43 upon application of an accidental external force, the sub-housing 22 and the base housing 17 will not be accidentally disconnected from each other since the engagement-holding projections 45 are engaged respectively in the engagement-holding recesses 46.

As described above, in the invention, the sub-housing is inserted into the base housing, and then if the open portion of the terminal receiving grooves in the sub-housing can be closed by the cover, it can be easily confirmed by the combination-confirming mechanism that the sub-housing is properly inserted in and combined with the base housing. If the terminal receiving grooves in the sub-housing can not be closed by the cover, it can be easily confirmed by the combination-confirming mechanism that the sub-housing is not properly inserted in and combined with the base housing. Thus, an incompletely-combined condition can be positively prevented.

What is claimed is:

1. A combined connector comprising:

a base housing having first terminal receiving grooves for receiving first metal terminals;

a sub-housing which is inserted in said base housing to be combined therewith, said sub-housing having second terminal receiving grooves for receiving second metal terminals and including a cover for closing an open portion of said second terminal receiving grooves; and combination-confirming means for confirming by the closing of the second terminal receiving grooves by the cover of said sub-housing, combined with said base housing, that said sub-housing is properly inserted in and combined with said base housing in a final position, wherein said cover is only closeable when said sub-housing is in said final position.

2. The combined connector according to claim 1, further comprising combination-holding means which includes an engagement-holding projection formed on one of said base housing and said sub-housing, and an engagement-holding recess formed in the other of said two housings, said engagement-holding projection being engaged in said engagement-holding recess when said sub-housing is properly inserted in and combined with said base housing.

3. The combined connector according to claim 1, wherein said base housing includes a base housing body having said plurality of juxtaposed first terminal receiving grooves, and a hood portion formed integrally with the base housing body, male metal terminals, received respectively in the first terminal receiving grooves in the base housing body, projecting into the interior of the hood portion for connection to respective mating terminals, and wherein said sub-housing includes a sub-housing body having said plurality of juxtaposed second terminal receiving grooves, the sub-housing body closing an open portion of the first terminal receiving grooves in the base housing body when said sub-housing is inserted in and combined with said base housing, and the cover which is integrally connected through a hinge to the sub-housing body so as to open and close the second terminal receiving grooves in the sub-housing body.

4. A combined connector comprising:

a base housing having first terminal receiving grooves for receiving first metal terminals;

a sub-housing which is inserted in said base housing to be combined therewith, said sub-housing having second terminal receiving grooves for receiving second metal terminals and including a cover for closing an open portion of said second terminal receiving grooves; and combination-confirming means for confirming by the closing of the second terminal receiving grooves by the cover of said sub-housing, combine with said base housing, that said sub-housing is properly inserted in and combined with said base housing, wherein said combination-confirming means includes a base housing-side positioning groove formed in said base housing, a sub-housing-side positioning groove, which is formed in said sub-housing, and is brought into alignment with the base housing-side positioning groove in contiguous relation thereto when said sub-housing is properly inserted in and combined with said base housing, and a positioning projection which is formed on the cover, and is engageable in the base housing-side positioning groove and the sub-housing-side positioning groove when said sub-housing is properly inserted in and combined with said base housing.

5. A combined connector comprising:

a base housing having first terminal receiving grooves for receiving first metal terminals;

a sub-housing which is inserted in said base housing to be combined therewith, said sub-housing having second terminal receiving grooves for receiving second metal terminals and including a cover for closing an open portion of said second terminal receiving grooves;

combination-confirming means for confirming by the closing of the second terminal receiving grooves by the cover of said sub-housing, combined with said base housing, that said sub-housing is properly inserted in and combined with said base housing; and cover engagement means which includes an engagement projection formed on said base housing, and an engagement recess formed in the cover, said engagement projection being retainingly engaged in said engagement recess when the cover closes the open portion of the second terminal receiving grooves.

6. A combined connector comprising:

a base housing for receiving metal terminals;

a sub-housing which is inserted in said base housing to be combined therewith, said sub-housing including a cover for closing an open portion of terminal receiving grooves for receiving metal terminals; and combination-confirming means by which it can be confirmed by the closing of the terminal receiving grooves by the cover of said sub-housing, combined with said base housing, that said sub-housing is properly inserted in and combined with said base housing, wherein said combination-confirming means includes a base housing-side positioning groove formed in said base housing, a sub-housing-side positioning groove, which is formed in said sub-housing, and is brought into alignment with the base housing-side positioning groove in contiguous relation thereto when said sub-housing is properly inserted in and combined with said base housing, and a positioning projection which is formed on the cover, and is engageable in the base housing-side positioning groove and the sub-housing-side positioning groove when said sub-housing is properly inserted in and combined with said base housing.

* * * * *